US005331332A

United States Patent [19]

West et al.

[11] Patent Number: 5,331,332

[45] Date of Patent: * Jul. 19, 1994

[54] WAVEGUIDE COUPLING STRUCTURE

[75] Inventors: Laurice J. West, Ventura; Wayne Pyatte, Thousand Oaks, both of Calif.

[73] Assignee: California Amplifier, Camarillo, Calif.

[ * ] Notice: The portion of the term of this patent subsequent to Jun. 1, 2010 has been disclaimed.

[21] Appl. No.: 961,142

[22] Filed: Oct. 14, 1992

Related U.S. Application Data

[63] Continuation-in-part of Ser. No. 831,900, Feb. 6, 1992, Pat. No. 5,216,432.

[51] Int. Cl.[5] ..... H01Q 13/00

[52] U.S. Cl. ..... 343/786; 343/772

[58] Field of Search ..... 343/786, 772, 783, 784, 343/789; 333/21 A, 21 R; H01Q 13/00

[56] References Cited

U.S. PATENT DOCUMENTS

| | | | |
|---|---|---|---|
| 2,645,769 | 7/1953 | Roberts | 343/786 |
| 2,805,335 | 9/1957 | Kendall et al. | 343/786 |
| 4,755,828 | 7/1988 | Grim | 343/786 |
| 5,216,432 | 6/1993 | West | 343/786 |

*Primary Examiner*—Donald Hajec
*Assistant Examiner*—Hoanganh Le
*Attorney, Agent, or Firm*—Freilich Hornbaker Rosen

[57] ABSTRACT

A structure (20) coupling a microwave signal to a waveguide (30) is provided. Transmission walls (26) are supported in the waveguide to only partially surround a probe (22) extending longitudinally from the waveguide wall. The probe preferably terminates at one end in a transmit/receive portion (36) directed into the waveguide internal space and at the other end in a launch portion extending through either the waveguide endwall (24) or sidewall (28). The structure is particularly suited for economical fabrication.

12 Claims, 2 Drawing Sheets

WAVEGUIDE COUPLING STRUCTURE

CROSS REFERENCES TO RELATED APPLICATIONS

This application is a continuation-in-part of application Ser. No. 07/831,900 filed Feb. 6, 1992, now U.S. Pat. No. 5,216,432, whose disclosure is by reference incorporated herein.

TECHNICAL FIELD

The present invention relates generally to waveguide coupling structures.

BACKGROUND ART

Patents relating to waveguides and couplings therefore include U.S. Pat. Nos. 2,825,060; 3,109,996; 3,146,410; 3,293,573; 3,431,515; 3,375,474; 3,483,489; 3,518,579; 3,555,553; 3,573,835; 3,732,508; 3,758,886; 3,942,138; 3,969,961; Re, 32,835, 4,533,884; 4,652,839 and 4,994,818 and United Kingdom Patent 1,402,624.

DISCLOSURE OF INVENTION

The present invention is directed to waveguide microwave signal coupling structures.

Structures in accordance with the invention are characterized by a transmission member only partially surrounding an elongate probe extending longitudinally within the waveguide. The probe has a transmission portion which preferably terminates at one end in a transmit/receive portion directed into the waveguide internal space and spaced from the waveguide endwall to couple to an electrical field strength maximum and at the other end in a launch portion extending through the waveguide wall. The transmission member has first and second portions transversely spaced from the probe transmission portion.

In a preferred embodiment the transmission portions define transmission walls.

In another preferred embodiment the transmission member defines a floor connecting the transmission walls.

Embodiments of the invention may form an longitudinally open side which facilitates insertion of the probe into the waveguide.

Embodiments of the invention find particular utility in coupling to circuits disposed proximate to the end of the waveguide and are particularly suited for economical fabrication.

The teachings of the invention may be extended to rectangular, square, elliptical and circular waveguides.

The novel features of the invention are set forth with particularity in the appended claims. The invention will be best understood from the following description when read in conjunction with the accompanying drawings.

MODES FOR CARRYING OUT THE INVENTION

Figure 1:
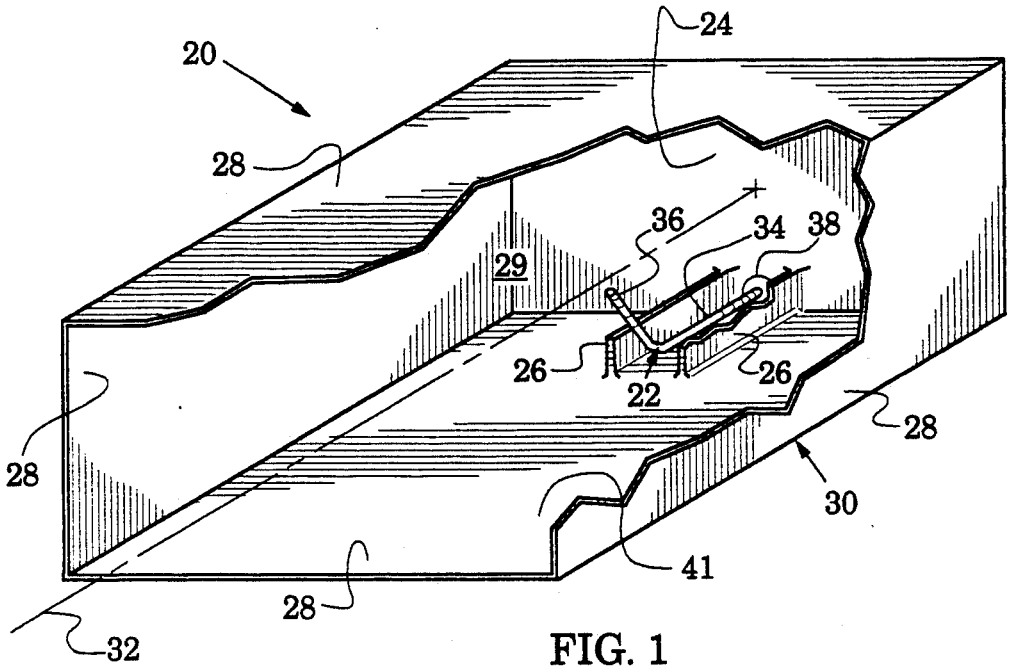
FIG. 1 is an isometric view of a preferred waveguide coupling structure in accordance with the present invention.

A preferred waveguide coupling structure embodiment 20, in accordance with the present invention is shown in the isometric view of FIG. 1. The embodiment 20 includes a probe 22 extending through a waveguide endwall 24 and directed between a pair of transversely spaced transmission walls 26 which project inwardly from the waveguide sidewall 28 and endwall 24 to only partially surround the probe 22.

The coupling structure 20 enables the coupling of a microwave signal through the waveguide endwall 24 and finds particular utility where circuits associated with the waveguide are disposed proximate to the endwall 24. The coupling structure is simple and is configured to enable economical fabrication as an integral part into which the probe can be inserted from the exterior.

Now describing the structure in detail, a transmission member in the form of transversely spaced transmission walls 26 (for clarity of illustration one wall is partially cut away) is supported within the internal space 29 of a waveguide 30 which is defined about a longitudinal axis 32 by an enclosing sidewall 28 terminating in a transverse endwall 24. The probe 22 is disposed proximate to the sidewall 28 and has a transmission portion 34 extending longitudinally between the spaced transmission walls 26 until it terminates in a transmit/receive portion 36 directed generally into the internal space 29.

Figure 2A:
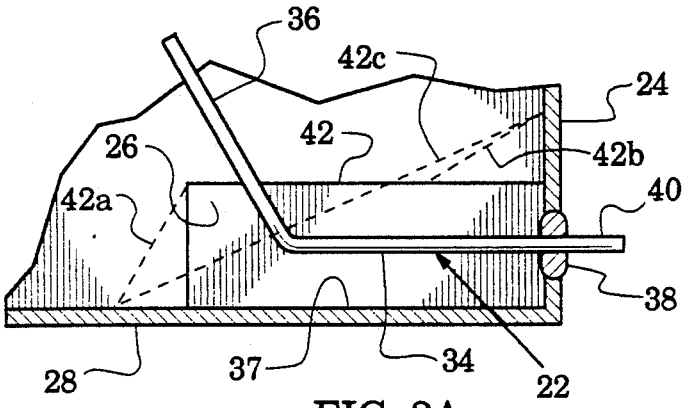
FIG. 2A is a sectional view along the longitudinal axis of the structure of FIG. 1.

FIG. 2A is a sectional view along the waveguide axis which further illustrates the transmission portion 34 and the inwardly directed transmit/receive portion 36 of the probe 22. The probe 22 is isolated from the endwall 24 by a coaxial dielectric 38 and terminates exterior to the endwall 24 in a launch portion 40 which may be configured in accordance with the external microwave circuits it is intended to couple with (e.g. define a flat portion to match a microstrip line). Although not shown, the coaxial dielectric 38 and endwall 24 may be configured to facilitate the use of an O ring environmental seal therebetween.

In the embodiment 20, illustrated in FIGS. 1 and 2A, where the sidewall 28 defines a waveguide with a rectangular transverse cross section, the probe transmission portion 34 is disposed over one of the broad walls 41 to facilitate coupling to an electrical field within the waveguide with the probe transmit/receive portion 36. The transmit/receive portion 36 may be appropriately spaced from the endwall 24 to maximize coupling with the electrical field strength maximum generally located a quarter wavelength therefrom.

Microwave signals are transferred between the transmit/receive portion 36 and launch portion 40 along the transmission portion 34 and transmission therealong is enhanced by the transmission walls 26 which form, with the proximate portion 37 of the sidewall 28 and the probe transmission portion 34, a longitudinally open sided transmission line. It should be apparent that this open sided transmission line permits adjustment of the transmit/receive portion 36 in addition to facilitating probe insertion into the waveguide 30.

The impedance presented to the waveguide 30 and external associated circuits thereof by the probe 22 and transmission members 26 may be adjusted by modifying the dimensions, configuration and placement thereof within the waveguide, e.g. varying the size of the transmission walls 26 and the spacing therebetween, varying the transverse placement of the transmission walls 26 and probe 22 within the waveguide and changes of the angle between the transmit/receive portion 36 and the sidewall proximate portion 37. Accordingly, although the transmission walls 26 and probe 22 are specifically centered about the waveguide axis 32 in FIG. 1, they generally may be moved transversely along the broad wall 41 to achieve desired coupling and impedance performances.

Although the transmission walls 26 of FIGS. 1, 2A are shown to define orthogonal surfaces they may define other surface arrangements within the teachings of the invention to optimize impedance, transmission loss and other probe parameters, e.g. in FIG. 2, the wall surface 42 may be tapered to join the endwall 24 and sidewall 28 respectively along paths 42*a* and 42*b* or the surface 42 may be directed along path 42*c*. Similar path variations are possible for other surfaces of the transmission walls 26.

Figure 2B:
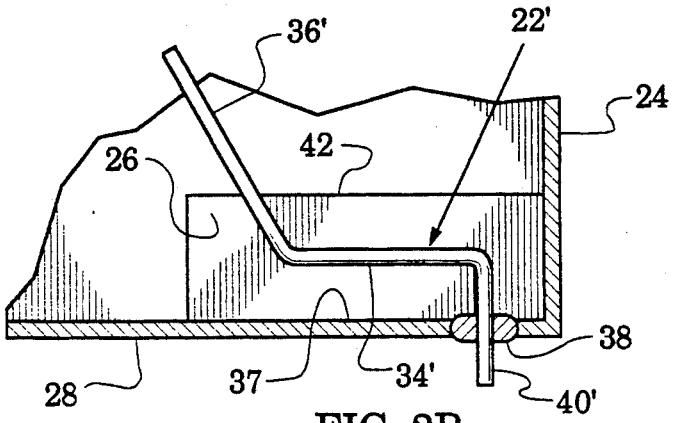
FIG. 2B is a view similar to FIG. 2A illustrating another preferred probe embodiment

FIG. 2B is a view similar to FIG. 2A illustrating another preferred probe embodiment 22' having a launch portion 40' directed away from the transmission portion 34' to extend through the waveguide sidewall 28. This probe embodiment may find utility in coupling to circuits proximate to both the waveguide endwall 24 and sidewall 28.

Figure 3:
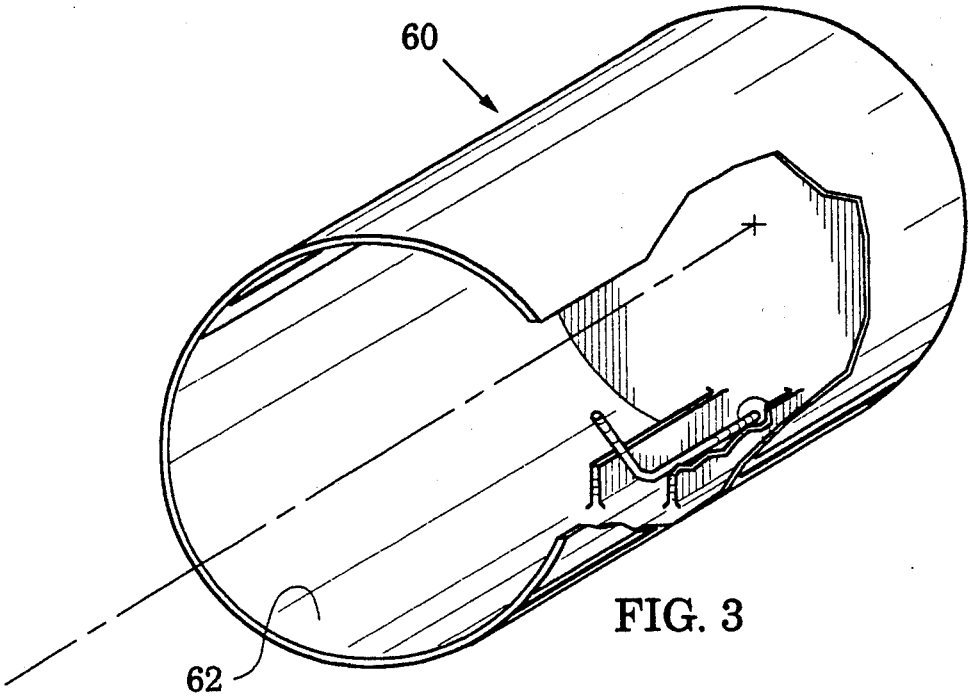
FIG. 3 is an isometric view of another preferred waveguide coupling structure.

Another waveguide coupling structure embodiment 60 is illustrated in the isometric view of FIG. 3 where the sidewall 62 defines a circular transverse cross section. Obviously the teachings of the invention can be extended to square and elliptical cross section waveguides.

Figure 4:
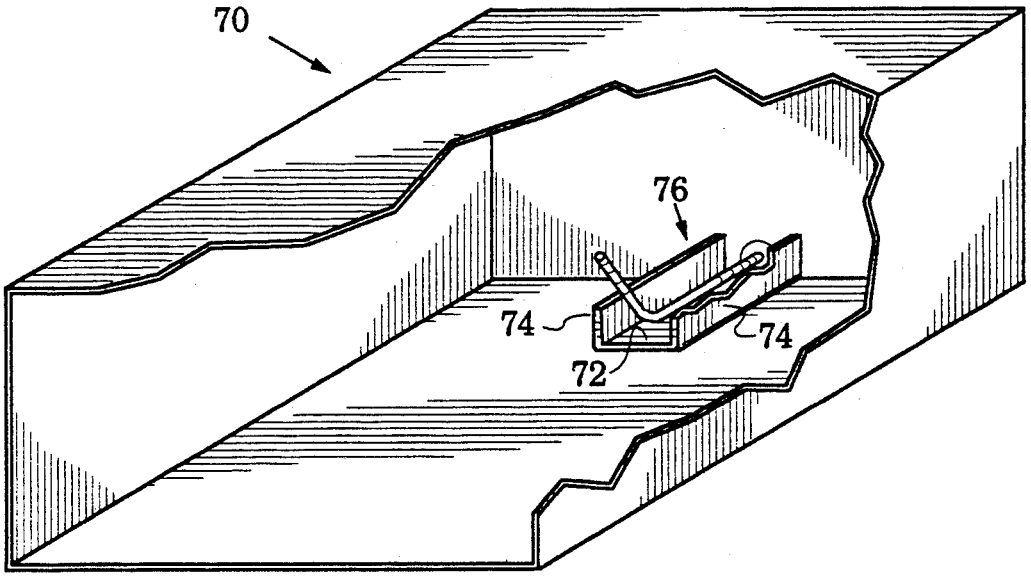
FIG. 4 is an isometric view of another preferred waveguide coupling structure.

Another preferred waveguide coupling structure embodiment 70 is shown in FIG. 4 where the transmission member defines a floor 72 connecting transmission walls 74 to form a transmission channel 76. The channel 76 may be integrally formed with the waveguide 70 or, alternatively, the channel 76 may be a separate part in applications of the invention where it is not desirable to have an integral waveguide structure.

The transmission members disclosed herein may be tapered as they extend from the waveguide walls (i.e., the cross section decreases with increasing distance from the walls) to facilitate realization of the coupling structure as a casting. Such tapering may also provide a means for controlling the impedance presented by the coupling structure.

From the foregoing it should now be recognized that a coupling structure has been disclosed herein especially suited for coupling, to a waveguide, associated circuits located proximate to the waveguide endwall. Structures in accordance with the present invention facilitate economical fabrication of integral parts into which probes can be externally inserted.

The preferred embodiments of the invention described herein are exemplary and numerous modifications, dimensional variations and rearrangements can be readily envisioned to achieve an equivalent result, all of which are intended to be embraced within the scope of the appended claims.

What is claimed is:

1. A waveguide coupling structure, comprising:

a waveguide comprising a wall including a transverse endwall portion and a sidewall portion extending longitudinally therefrom to define an internal space;

an elongate probe having a transmit/receive portion at a first end, a launch portion at a second end, and a transmission portion connecting said transmit/-receive and launch portions;

means for mounting said probe on said wall with said transmission portion extending longitudinally in said internal space and said launch portion extending externally through said wall; and a partially open transmission member having first and second transmission walls supported by said waveguide wall and oriented longitudinally in said waveguide internal space, said transmission walls being transversely spaced from one another and accommodating said probe transmission portion therebetween.

2. The waveguide coupling structure of claim 1 wherein said probe launch portion extends longitudinally through said endwall portion.

3. The waveguide coupling structure of claim 1 wherein said probe launch portion extends transversely through said sidewall portion.

4. The waveguide coupling structure of claim 1 wherein said probe transmit/receive portion extends from said probe transmission portion into said internal space.

5. The waveguide coupling structure of claim 1 wherein said mounting means comprises a coaxial dielectric disposed between said probe and said wall.

6. Apparatus for coupling electromagnetic signals to a waveguide having a wall including a transverse endwall portion and a sidewall portion extending longitudinally therefrom to define an internal space, the apparatus comprising;

an elongate probe having a transmit/receive portion at a first end, a launch portion at a second end, and a transmission portion connecting said transmit/-receive and launch portions;

means for mounting said probe on said wall with said transmission portion extending longitudinally in said internal space and said launch portion extending externally through said wall; and a partially open transmission member having first and second transmission walls supported by said waveguide wall and oriented longitudinally in said waveguide internal space, said transmission walls being transversely spaced from one another and accommodating said probe transmission portion therebetween.

7. Apparatus of claim 6 wherein said probe launch portion extends longitudinally through said endwall portion.

8. Apparatus of claim 6 wherein said probe launch portion extends transversely through said sidewall portion.

9. Apparatus of claim 6 wherein said probe transmit/-receive portion extends from said probe transmission portion into said internal space.

10. Apparatus of claim 6 wherein said transmission member defines a transverse floor disposed between said probe transmission portion and said waveguide wall to connect said first and second transmission walls.

11. Apparatus of claim 6 wherein said mounting means comprises a coaxial dielectric disposed between said probe and said wall.

12. Method for coupling electromagnetic signals to a waveguide having a wall including a transverse endwall portion and a sidewall portion extending longitudinally therefrom to define an internal space, the method comprising the steps of;

providing an elongate probe having a transmit/-receive portion at a first end, a launch portion at a second end, and a transmission portion connecting said transmit/receive and launch portions;

mounting said probe on said wall with said transmission portion extending longitudinally in said internal space and said launch portion extending externally through said wall;

supporting, with said waveguide wall, a pair of transmission walls to extend longitudinally in said waveguide internal space; and transversely spacing said transmission walls from one another to accommodate said probe transmission portion therebetween.

* * * * *